US008021198B2

(12) United States Patent
Lim et al.

(10) Patent No.: US 8,021,198 B2
(45) Date of Patent: Sep. 20, 2011

(54) LOW-PROFILE POWER ADAPTER

(75) Inventors: Way Chet Lim, Petaluma, CA (US); Cameron Frazier, San Carlos, CA (US); Kevin Walsh, Burlingame, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/135,044

(22) Filed: Jun. 6, 2008

(65) Prior Publication Data

US 2009/0305578 A1 Dec. 10, 2009

(51) Int. Cl.
*H01R 13/405* (2006.01)

(52) U.S. Cl. ..... 439/736; 29/883

(58) Field of Classification Search ..... 439/736, 439/604, 606, 885; 29/858, 883
See application file for complete search history.

(56) References Cited

U.S. PATENT DOCUMENTS

| | | | | |
|---|---|---|---|---|
| 2,537,370 | A | 1/1951 | Parnes | |
| 2,762,026 | A * | 9/1956 | Knohl | 439/748 |
| 2,947,914 | A * | 8/1960 | Simons | 361/729 |
| 4,028,654 | A | 6/1977 | Bullard et al. | |
| 4,205,291 | A * | 5/1980 | Flentge | 336/92 |
| 4,375,308 | A | 3/1983 | Wilkinson | |
| 4,519,015 | A * | 5/1985 | Lin | |
| 5,106,317 | A * | 4/1992 | Taylor | |
| 5,119,204 | A | 6/1992 | Hashimoto et al. | |
| 5,137,467 | A * | 8/1992 | Arai | 439/374 |
| 5,184,285 | A * | 2/1993 | Murphy et al. | 361/813 |
| 5,224,879 | A * | 7/1993 | Mullins et al. | 439/651 |
| 5,494,449 | A | 2/1996 | Chioo | |
| 5,616,051 | A | 4/1997 | Rogers | |
| 5,641,311 | A * | 6/1997 | Chuang | |
| 5,755,820 | A * | 5/1998 | Lan-Jen | 439/694 |
| 5,928,035 | A * | 7/1999 | Jankowsky et al. | 439/607.36 |
| 6,297,982 | B1 | 10/2001 | Wu | |
| 6,312,271 | B1 | 11/2001 | Tseng | |
| 6,341,961 | B1 * | 1/2002 | Juntwait | 439/63 |
| 6,505,402 | B2 * | 1/2003 | Moriwake et al. | 29/883 |
| 6,527,596 | B1 * | 3/2003 | Su | |
| 6,644,984 | B2 | 11/2003 | Vista et al. | |
| 6,846,203 | B1 * | 1/2005 | Su | |

(Continued)

FOREIGN PATENT DOCUMENTS

CN 200963813 Y 10/2007

(Continued)

OTHER PUBLICATIONS

Notification from Chinese Patent Office for Chinese Application Utility Model No. 200920155037.6 mailed Dec. 4, 2009.

(Continued)

*Primary Examiner* — Neil Abrams

(57) ABSTRACT

A low-profile power adapter is disclosed. In one embodiment, a low profile power adapter is facilitated by improved approaches to construct and assembly of a power adapter plug for the power adapter. According to one aspect, a base for a power adapter plug of a power adapter can include a metal base connected to a blade (or prong) of the power adapter plug. The metal base can provide mechanical support to the blade as well as electrical connectivity to an internal terminal for the power adapter plug. According to another aspect, internal terminals used by a power adapter plug of a power adapter can be flexibly positioned on the power adapter plug, thereby facilitating interconnection with electrical components used by the power adapter.
A molded base can be formed around the metal base leaving the blade and terminals exposed.

26 Claims, 9 Drawing Sheets

U.S. PATENT DOCUMENTS

| | | | | |
|---|---|---|---|---|
| 6,851,955 | B2 | 2/2005 | Chen | |
| 6,860,743 | B2 | 3/2005 | Ekkul et al. | |
| 6,981,896 | B2 * | 1/2006 | Su | 439/606 |
| 7,002,808 | B2 | 2/2006 | Lim et al. | |
| 7,029,291 | B2 * | 4/2006 | Chen | 439/79 |
| 7,101,226 | B1 | 9/2006 | Gilliland | |
| 7,118,425 | B2 * | 10/2006 | Chen | 439/736 |
| 7,207,809 | B2 * | 4/2007 | Sasaki et al. | 439/79 |
| 7,212,420 | B2 | 5/2007 | Liao | |
| 7,287,991 | B1 | 10/2007 | Li | |
| 7,344,385 | B2 | 3/2008 | Chen | |
| 7,499,301 | B2 | 3/2009 | Zhou | |
| 7,573,159 | B1 | 8/2009 | DeIuliis et al. | |
| 2003/0153200 | A1 * | 8/2003 | Vista et al. | |
| 2004/0075989 | A1 * | 4/2004 | Wong | 361/752 |
| 2004/0110397 | A1 * | 6/2004 | Chen | |
| 2004/0204177 | A1 | 10/2004 | Pon | |
| 2006/0270250 | A1 * | 11/2006 | Allen | |
| 2009/0227122 | A1 | 9/2009 | Jubeliver et al. | |
| 2009/0289596 | A1 * | 11/2009 | McGinley et al. | |
| 2010/0061130 | A1 * | 3/2010 | Zhang et al. | |
| 2010/0112848 | A1 * | 5/2010 | Early et al. | 439/441 |
| 2011/0124227 | A1 | 5/2011 | Stiehl et al. | |

FOREIGN PATENT DOCUMENTS

| | | | |
|---|---|---|---|
| CN | 101154819 | A | 4/2008 |
| CN | 201112509 | Y | 10/2008 |
| FR | 2763182 | * | 11/1998 |
| JP | 2002-149285 | | 5/2002 |
| WO | WO 2008/067726 | * | 6/2008 |

OTHER PUBLICATIONS

U.S. Appl. No. 12/480,602 entitled, "Compact Power Adapter", filed Jun. 8, 2009.

U.S. Appl. No. 12/489,429 entitled, "Compact Device Housing and Assembly Techniques Therefor", filed Jun. 23, 2009.

Office Action for U.S. Appl. No. 12/480,602, mailed Oct. 14, 2009.*

Final Office Action for U.S. Appl. No. 12/480,602, mailed Jun. 30, 2010.*

International Search Report and Written Opinion for International Application No. PCT/US2010/035916, mailed Aug. 19, 2010.*

Office Action for U.S. Appl. No. 12/480,602, mailed Jun. 30, 2010.

Notice of Allowance for U.S. Appl. No. 12/480,602, mailed Nov. 1, 2010.

Office Action for U.S. Appl. No. 13/018,208, mailed Mar. 31, 2011.

* cited by examiner

LOW-PROFILE POWER ADAPTER

BACKGROUND OF THE INVENTION

1. Field of the Invention

The present invention relates to power adapters for electronic devices.

2. Description of the Related Art

There exists today may different portable electronic devices that are powered by rechargeable batteries. Examples of such portable electronic devices include mobile phones, portable media players, personal digital assistants (PDAs), etc. To facilitate recharging of the rechargeable batteries, a portable electronic device is normally sold with a power adapter. Typically, the power adapter has a power plug for coupling to an AC outlet. The power plug is a significant part of a power adapter that is required to meet certain specifications for safety reasons. The power adapter also contains electronic circuitry that converts AC power acquired from the AC outlet into DC power and outputs DC power via a cord having a connector. The connector of the cord connects to the portable electronic device and allows the DC power to be received at the portable electronic device so as to power the portable electronic device and/or charge the rechargeable battery. There is, however, an ongoing demand for small and thinner power adapters. Accordingly, there is a need to provide improved power adapters are efficient in their construction and operation.

SUMMARY OF THE INVENTION

The invention relates to low-profile power adapters. In one embodiment, a low profile power adapter is facilitated by improved approaches to construct and assembly of a power adapter plug for the power adapter. According to one aspect, a base for a power adapter plug of a power adapter can include a metal base connected to a blade (or prong) of the power adapter plug. The metal base can provide mechanical support to the blade as well as electrical connectivity to an internal terminal for the power adapter plug. According to another aspect, internal terminals used by a power adapter plug of a power adapter can be flexibly positioned on the power adapter plug, thereby facilitating interconnection with electrical components used by the power adapter.

The invention may be implemented in numerous ways, including, but not limited to, as a system, device, or apparatus, or method. Example embodiments of the present invention are discussed below.

As a power adapter, one embodiment of the invention can, for example, include at least: a first metal prong having a front end and a back end; a first metal base mechanically and electrically connected to the back end of the first prong, the first metal base including or coupling to at least a first terminal; a second metal prong having a front end and a back end; a second metal base mechanically and electrically connected to the back end of the second prong, the second metal base including or coupling to at least a second terminal; and a molded base formed around the first and second metal bases such that the first and second metal prongs are at least partially exposed and the first and second metal bases are not exposed except for the first and second terminals which are at least partially exposed, the molded base being non-conductive.

As a method for assembling a power adapter, one embodiment of the invention can, for example, include at least: obtaining a first metal prong for the power adapter, the first metal prong having a front end and a back end, with the back end having at least one attachment feature; obtaining a first metal base having at least one opening to receive the at least one attachment feature of the first metal prong; securing the first metal prong proximate to the at least one opening of the first metal base using the at least one attachment feature, thereby providing a mechanical and electrical connection between the first metal prong and the first metal base; and forming a non-conductive base around the first metal base to encapsulate the first metal base while the first metal prong remains at least substantially exposed.

As a power adapter plug, one embodiment of the invention can, for example, include at least: a first metal prong having a front end and a back end; a first metal base mechanically and electrically connected to the back end of the first prong, the first metal base including or coupling to at least a first terminal; a second metal prong having a front end and a back end; a second metal base mechanically and electrically connected to the back end of the second prong, the second metal base including or coupling to at least a second terminal; and a non-conductive base formed around the first and second metal bases such that the first and second metal prongs and the first and second terminals are at least partially exposed.

Various aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF THE INVENTION

The invention relates to low-profile power adapters. In one embodiment, a low profile power adapter is facilitated by improved approaches to construct and assembly of a power adapter plug for the power adapter. According to one aspect, a base for a power adapter plug of a power adapter can include a metal base connected to a blade (or prong) of the power adapter plug. The metal base can provide mechanical support to the blade as well as electrical connectivity to an internal terminal for the power adapter plug. According to another aspect, internal terminals used by a power adapter plug of a power adapter can be flexibly positioned on the power adapter plug, thereby facilitating interconnection with electrical components used by the power adapter.

Exemplary embodiments of the present invention are discussed below with reference to the various figures. However, those skilled in the art will readily appreciate that the detailed description given herein with respect to these figures is for explanatory purposes, as the invention extends beyond these embodiments.

Figure 1A:
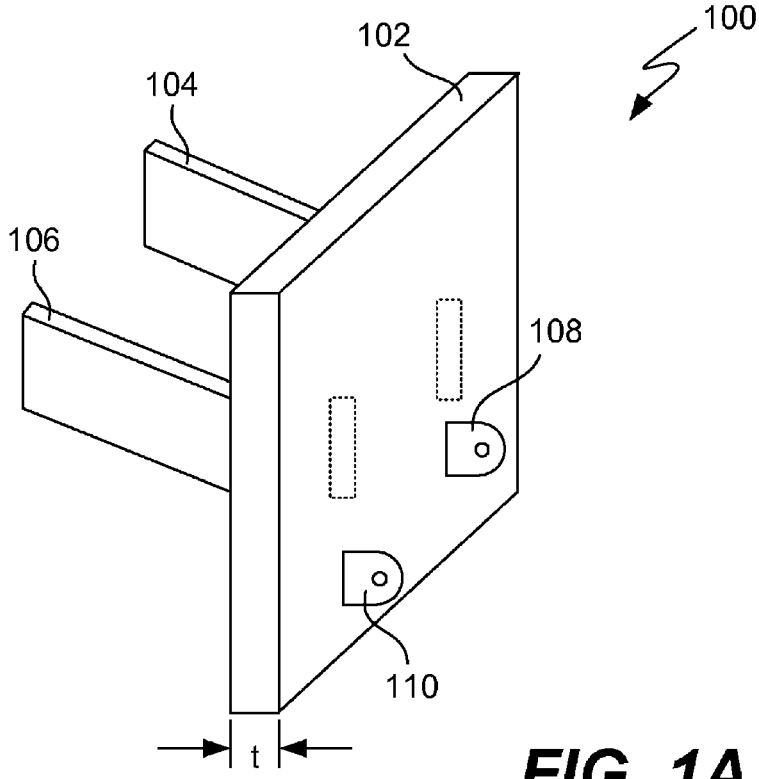
FIG. 1A is a perspective view of a power adapter plug according to one embodiment of the invention.

FIG. 1A is a perspective view of a power adapter plug 100 according to one embodiment of the invention. The power adapter plug 100 includes a base 102, a first blade 104 and a second blade 106. In addition, the power adapter plug 100 includes a first terminal 108 and a second terminal 110. The base 102 is typically formed from a non-conductive material, such as plastic, and serves to support the first blade 104 and the second blade 106. The blades 104 and 106 extend outward from a first side (e.g., front side) of the base 102. The terminals 108 and 110 extend outward from a second side (e.g., back side) of the base 102. Although the blades 104 and 106 have a rectangular cross-section, the blades 204 and 106 can have other cross-sectional shapes. Hence, more generally, the blades are referred to as prongs herein.

The terminals 108 and 110 can be placed at any location on the second side of the base 102. In other words, in the terminals 108 and 110 do not have to be positioned directly behind the corresponding blades 104 and 106 as would be the case with conventional approaches. Instead, the terminals 108 and 110 can be offset from the positions of the blades 104 and 106, such that the terminals 108 and 110 can be positioned anywhere on the second side of the base 102. By controlling the position of the terminals 108 and 110, assembly of the power adapter 102 with other electrical components, such as a printed circuit board, can be performed in a space efficient manner. For example, the power adapter plug 100 can be directly attached to a printed circuit board since the position of the terminals 108 and 110 can be designed so as to correspond to connection terminals of the printed circuit board.

In one embodiment, advantageously, the thickness t of the base 102 is thin. The thickness t of the base 102 is, for example, less than about 0.5-3.0 millimeters. In one specific example the thickness t of the base 102 can be about 2.5 millimeters. As a result, the power adapter plug 100 can be considered a low-profile power adapter.

Figure 1B:
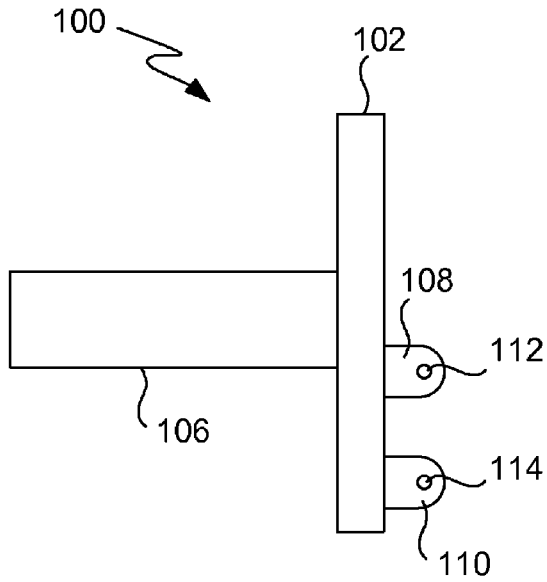
FIG. 1B illustrates a side view of the power adapter plug according to the embodiment illustrated in FIG. 1A.

FIG. 1B illustrates a side view of the power adapter plug 100 according to the embodiment illustrated in FIG. 1A. As illustrated in FIG. 1B, the terminals 108 and 110 of the power adapter plug 100 are repositioned to a lower portion of the base 102. In addition, to facilitate electrical connection (e.g., solder connection) with respect to other electrical components, such as a printed circuit board, the first terminal 108 can include an opening 112 and the second terminal 110 can include an opening 114.

Figure 1C:
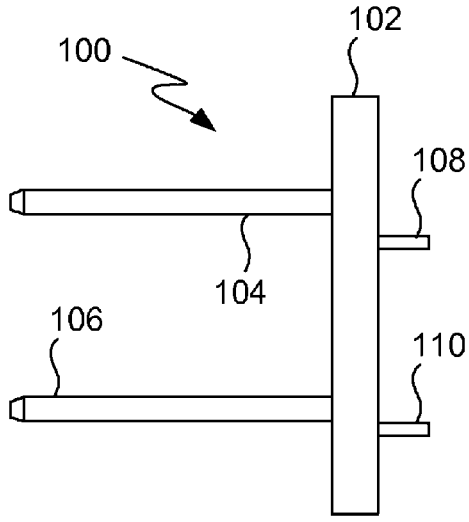
FIG. 1C illustrates a top view of the power adapter plug according to the embodiment illustrated in FIG. 1A.

FIG. 1C illustrates a top view of the power adapter plug 100 according to the embodiment illustrated in FIG. 1A. The power adapter plug 100 illustrated in FIG. 1C shows that the terminals 108 and 110 have been be positioned (i.e., offset) toward one side of the base 102.

Figure 2:
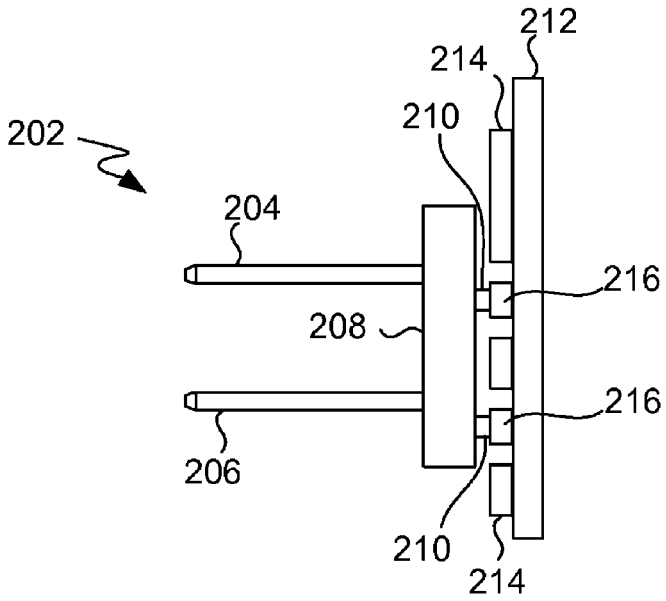
FIG. 2 is a side view of an electronic device assembly according to one embodiment of the invention.

FIG. 2 is a side view of an electronic device assembly 200 according to one embodiment of the invention. The electronic device assembly 200 is for a power adapter, such as a power adapter that connects to an AC outlet and produces a DC output for powering an electronic device and/or charging a rechargeable battery of the electronic device.

The electronic device assembly 200 includes a power adapter plug 202. The power adapter plug 202 can, for example, be constructed similar to the power adapter plug 100 illustrated in FIGS. 1A-1C. The power adapter plug 202 includes a first blade 204, a second blade 206, and a base 208. The base 208 supports the first blade 204 and the second blade 206. The base 208 also supports terminals 210. The electronic device assembly 200 also includes a printed circuit board 212. The power adapter plug 202 can be mechanically and electrically connected to the printed circuit board 212. The printed circuit board 212 includes a plurality of electrical components 214 attached onto at least one side of the printed circuit board 212 to provide various electrical operations. The terminals 210 of the base 208 of the power adapter plug 202 can be utilized to couple to corresponding connection points 216 of the printed circuit board 212. Accordingly, in one embodiment, the terminals 210 of the power adapter plug 202 can be mechanically and electrically connected to corresponding ones of the connection points 216 of the printed circuit board 212. These connections, for example, can be formed by soldering the terminals 210 (directly or indirectly) to the corresponding connection points 216. As another example, connectors can be used to provide mechanical and/or electrical connection of the power adapter plug 202 and the printed circuit board 212.

In one embodiment, the power adapter plug 202 is a low-profile adapter plug which is able to couple directly to the printed circuit board 212 without intervening mechanical assistance by other components. As a result, the overall thickness of an electronic device (e.g., power adapter) being formed to enclose the electronic device assembly 200 can be smaller and thinner. As shown in FIG. 2, the base 208 of the power adapter plug 200 is positioned adjacent the electrical components 214 mounted on the printed circuit board 212. However, in another embodiment, the base 208 of the power adapter plug 200 can be positioned immediately adjacent the printed circuit board 212 (without any intervening electrical components 214).

Once the power adapter plug 202 is electrically (and possibly mechanically) connected to the printed circuit board 212, the power adapter assembly 200 can be enclosed within an external device housing (not shown), thereby forming a power adapter product. In operation, the power adapter assembly 200 can serve to convert AC power into DC power, and then supply the DC power to electrical components of an electronic device which can be electrically connected to the power adapter assembly 200 directly (e.g., integral with electronic device) or indirectly (e.g., by connector and/or wire (cord). For example, the blades 204 and 206 of the power adapter assembly 200 can be inserted into an AC electrical outlet from which high-voltage alternating current can be acquired. The electrical components 214 associated with the printed circuit board 212 can operate to convert the high-voltage Alternating Current (AC) into a low-voltage Direct Current (DC) which is suitable for use for powering electrical components of the electronic device.

Although the power adapter assembly 200 illustrated in FIG. 2 includes a printed circuit board 212, in other embodiments, the printed circuit board 212 can be replaced with a different substrate. For example, the substrate can alternatively be a flexible substrate (e.g., flex-circuit).

Figure 3:
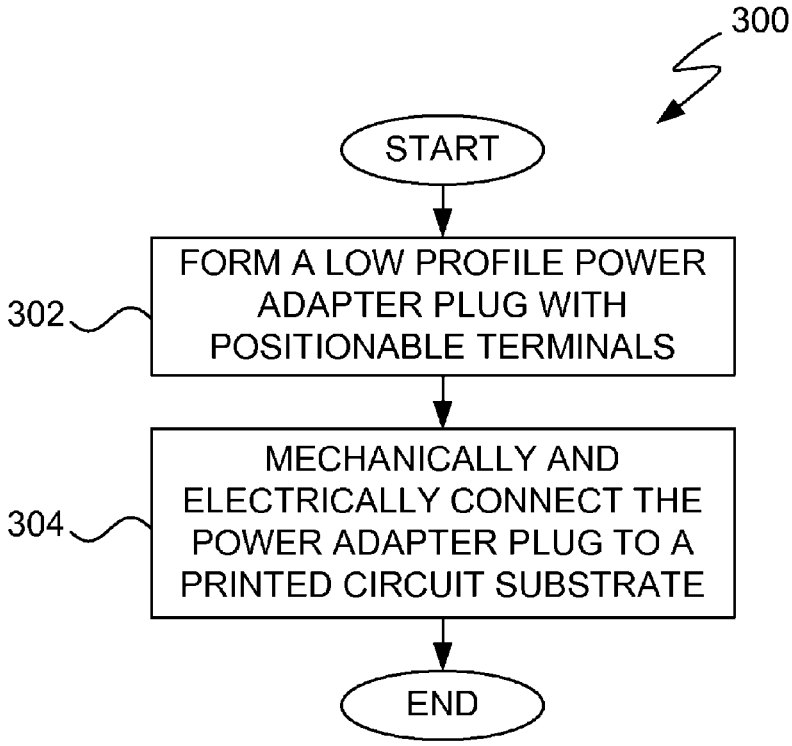
FIG. 3 is a flow diagram of an electronic device assembly process according to one embodiment of the invention.

FIG. 3 is a flow diagram of an electronic device assembly process 300 according to one embodiment of the invention. The electronic device assembly process 300 can, for example, correspond to a process utilized to assemble the electronic device assembly 200 illustrated in FIG. 2.

The electronic device assembly process 300 can initially form 302 a low-profile power adapter plug with positionable terminals. As an example, the low-profile power adapter plug can correspond to the power adapter plug 100 illustrated in FIGS. 1A-1C or the power adapter plug 202 illustrated in FIG. 2. After the low-profile power adapter plug has been formed 302, the power adapter plug can be mechanically and electrically connected 304 to a printed circuit substrate. The printed circuit substrate can, for example, pertained to a printed circuit board. However, in other embodiments, the printed circuit substrate can correspond to a flexible printed circuit substrate, such as a flex-circuit.

As noted above terminals on a base of a power adapter can be positioned (or repositioned) to a more desirable location. In other words, the terminals can be positioned anywhere on a base of the power adapter. There are various embodiments for positioning the terminals. In one embodiment, a terminal can result from a portion of a metal base that is provided internal the base of the power adapter plug. In another embodiment, one or more connection members can link a metal base to a terminal location.

Figure 4A:
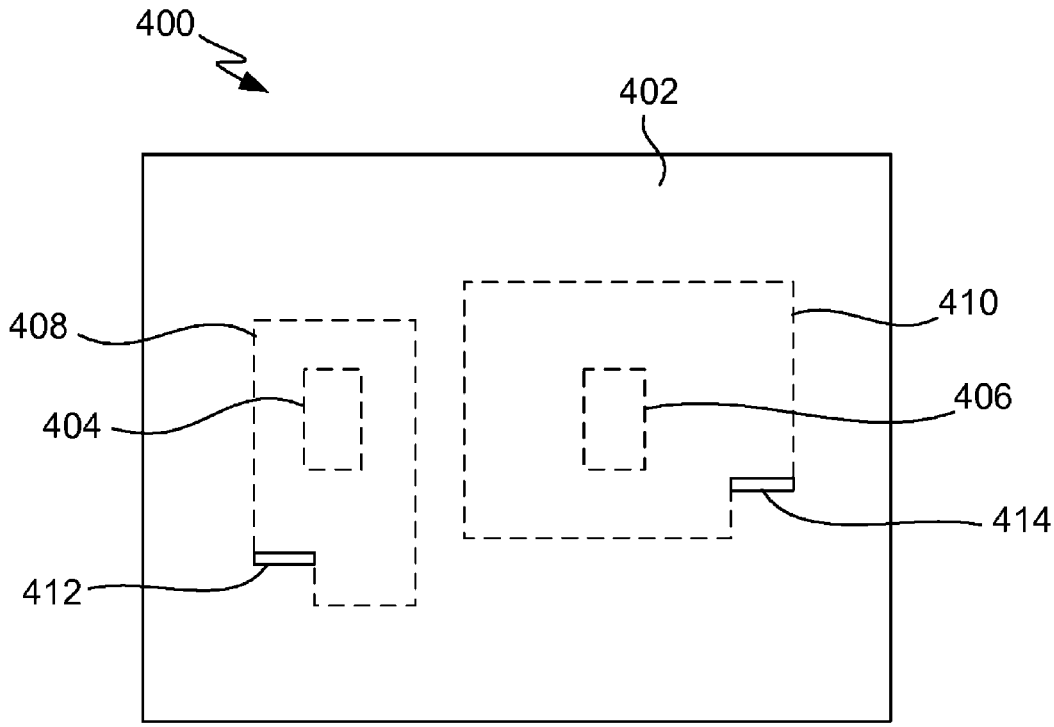
FIG. 4A is a back view of a power adapter plug according to one embodiment of the invention.

FIG. 4A is a back view of a power adapter plug 400 according to one embodiment of the invention. The power adapter plug 400 can, for example, correspond to the power adapter plug 100 illustrated in FIGS. 1A-1C or the power adapter plug 202 illustrated in FIG. 2. The back view illustrated in FIG. 4A illustrates a back side of a base 402 of the power adapter plug 400. The base 402 can, for example, be performed by an injection molding. The corresponding front side (not shown) of the base 402 has a pair of blades 404 and 406 extending therefrom. More generally, the blades 404 and 406 can be referred to as prongs. Internal to the base 402 is a first base plate 408 and a second base plate 410. Although dependent on implementation, in one embodiment, the first base plate 408 and the second base plates 410 are thin metal plates, such as stainless steel with a thickness of about 0.1-0.5 millimeters.

The first base plate 408 is coupled to a rear end of the blade 404. The first base plate 408 serves as a structural base for the blade 404. In one implementation, the first base plate 408 is mechanically connected to the blade 404. The mechanical connection can, for example, be provided by (i) interlocking the blade 404 with the first base plate 408, (ii) soldering the parts together, and/or (iii) using some attachment members (such as screws, fasteners or rivets). In addition to providing mechanical connection, once the first base plate 408 is connected to the blade 404, the blade 404 and the first base plate 408 are also electrically connected.

Similarly, the second base plate 410 is coupled to a rear end of the blade 406. The second base plate 410 serves as a structural base for the blade 406. In one implementation, the second base plate 410 is mechanically connected to the blade 406. The mechanical connection can, for example, be provided by (i) interlocking the blade 406 with the second base plate 410, (ii) soldering the parts together, and/or (iii) using some attachment members (such as screws, fasteners or rivets). In addition to providing mechanical connection, once the second base plate 410 is connected to the blade 406, the blade 406 and the second base plate 410 are also electrically connected.

The first base plate 408 and the second base plate 410 can also respectively serve to support a first terminal 412 and a second terminal 414. The terminals 412 and 414 are at least partially exposed and thus accessible on the back side of the base 402. The terminals 412 and 414 serve as internal connection points for the power adapter plug 400. Hence, the terminals 412 and 414 can also be referred to as internal terminals. The utilization of the base plates 408 and 410 operates to facilitate the placement of the terminals 412 and 414 anywhere along the back side of the base 402. Consequently, the interconnection of the power adapter plug 400 with respect to other electrical circuitry or components is greatly facilitated.

Figure 4B:
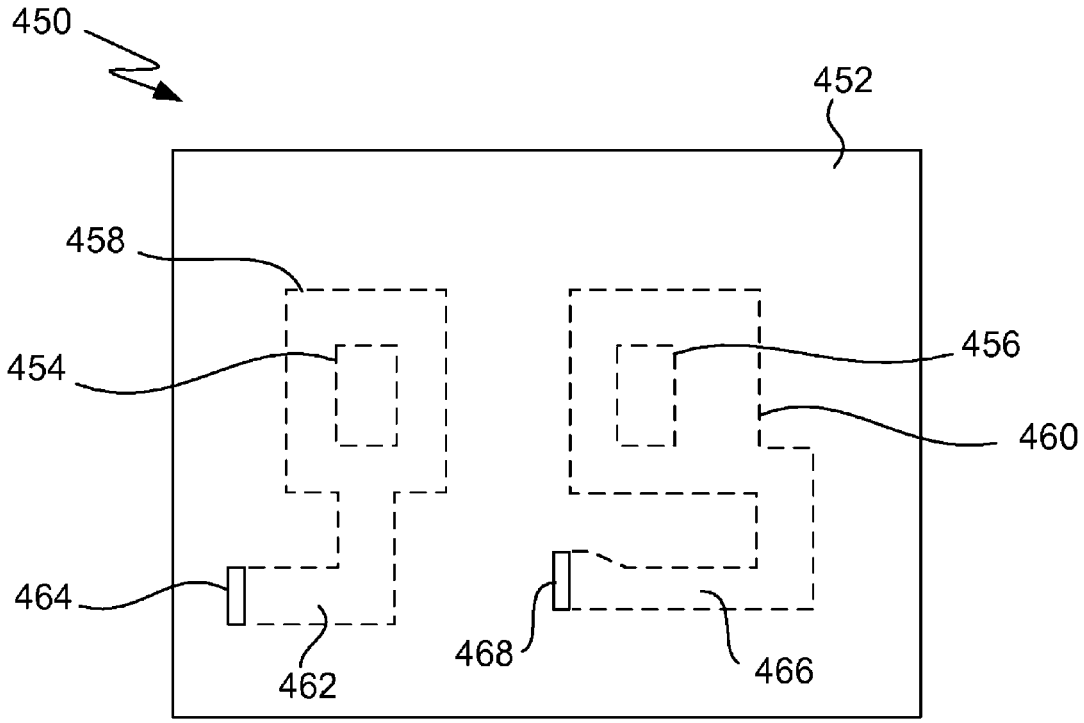
FIG. 4B is a back view of a power adapter plug according to another embodiment of the invention.

FIG. 4B is a back view of a power adapter plug 450 according to another embodiment of the invention. The power adapter plug 450 can, for example, correspond to the power adapter plug 100 illustrated in FIGS. 1A-1C or the power adapter plug 202 illustrated in FIG. 2. The back view illustrated in FIG. 4B illustrates a back side of a base 452 of the power adapter plug 450. The base 452 can, for example, be performed by an injection molding. The corresponding front side (not shown) of the base 452 has a pair of blades 454 and 456 extending therefrom. More generally, the blades 454 and 456 can be referred to as prongs. Internal to the base 452 is a first base plate 458 and a second base plate 460. In one embodiment, the first base plate 458 and the second base plates 460 are thin metal plates, such as stainless steel with a thickness of about 0.1-0.5 millimeters.

The first base plate 458 is coupled to a rear end of the blade 454. The first base plate 458 serves as a structural base for the blade 454. In one implementation, the first base plate 458 is mechanically connected to the blade 454. The mechanical connection can, for example, be provided by (i) interlocking the blade 454 with the first base plate 458, (ii) soldering the parts together, and/or (iii) using some attachment members (such as screws, fasteners or rivets). In addition to providing mechanical connection, once the first base plate 458 is connected to the blade 454, the blade 454 and the first base plate 458 are also electrically connected. In addition, the base 452 can further include a first connection member 462 that provides a path within the base 452 from the first base plate 458 to a first terminal 464. The first terminal 464 is electrically connected to the first base plate 458 via the first connection member 462. The first terminal 464 is at least partially exposed and thus accessible on the back side of the base 452. The first connection member 462 can be integrally formed with the first base plate 458. Alternatively, the first connection member 462 can be separately formed and subsequently connected to the first base plate 458. The first connection member 462 thus permits the first terminal 464 to be positioned (and oriented) in any position along the back side of the base 452.

Similarly, the second base plate 460 is coupled to a rear end of the blade 456. The second base plate 460 serves as a structural base for the blade 456. In one implementation, the second base plate 460 is mechanically connected to the blade 456. The mechanical connection can, for example, be provided by (i) interlocking the blade 456 with the second base plate 460, (ii) soldering the parts together, and/or (iii) using some attachment members (such as screws, fasteners or rivets). In addition to providing mechanical connection, once the second base plate 460 is connected to the blade 456, the blade 456 and the second base plate 460 are also electrically connected. In addition, the base 452 can further include a second connection member 466 that provides a path within the base 452 from the second base plate 460 to a second terminal 468. The second terminal 468 is electrically connected to the second base plate 460 via the second connection member 466. The second terminal 468 is at least partially exposed and thus accessible on the back side of the base 452. The second connection member 466 can be integrally formed with the second base plate 460. Alternatively, the second connection member 466 can be separately formed and subsequently connected to the second base plate 460. The second connection member 466 thus permits the second terminal 468 to be positioned (and oriented) in any position along the back side of the base 452.

The terminals 464 and 468 serve as internal connection points for the power adapter plug 450. Hence, the terminals 464 and 468 can also be referred to as internal terminals. The utilization of the base plates 458 and 460 together with the respective connection members 462 and 466 facilitates the placement of the terminals 464 and 468 anywhere along the back side of the base 452. Consequently, the interconnection of the power adapter plug 450 with respect to other electrical circuitry or components is greatly facilitated.

Figure 4C:
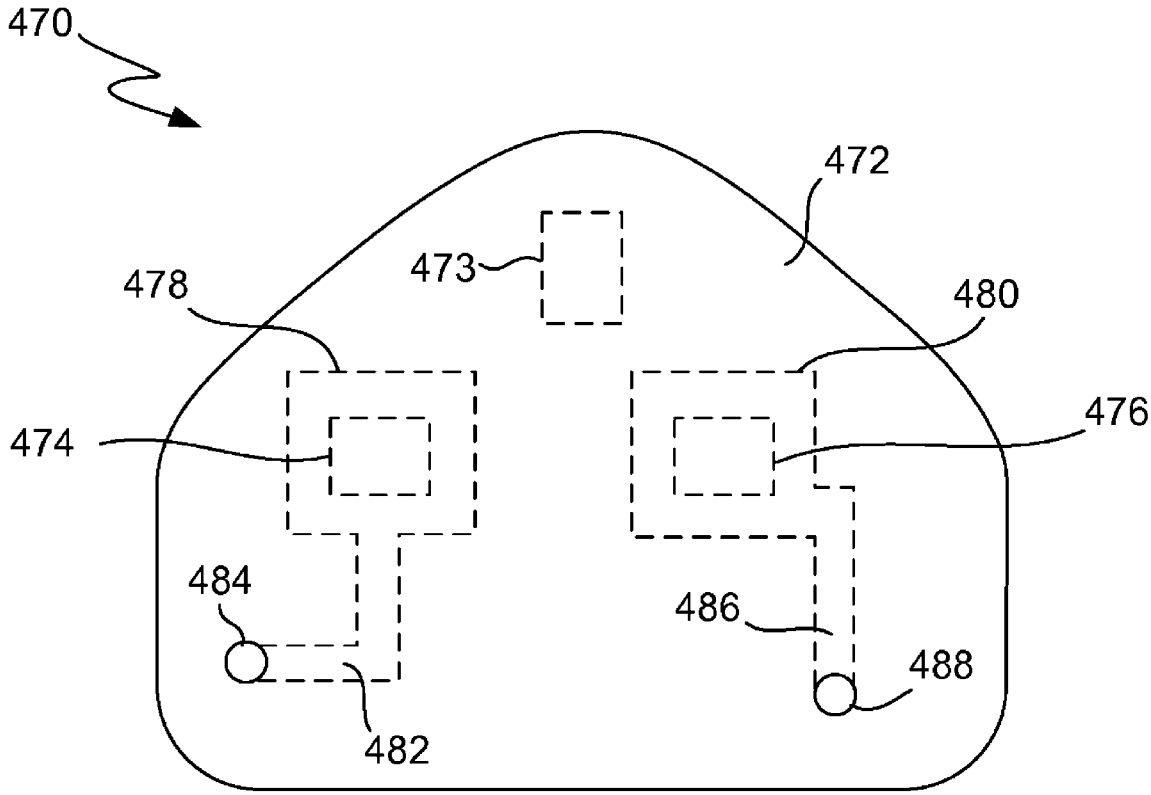
FIG. 4C is a back view of a power adapter plug according to still another embodiment of the invention.

FIG. 4C is a back view of a power adapter plug 470 according to still another embodiment of the invention. The power adapter plug 470 is generally similar to the power adapter plug 450 illustrated in FIG. 4B. However, the power adapter plug 470 has a European plug configuration. The back view illustrated in FIG. 4C illustrates a back side of a base 472 of the power adapter plug 470. The base 472 can, for example, be performed by an injection molding. The corresponding front side (not shown) of the base 472 has a front prong 473 and a pair of rear prongs 474 and 476 extending therefrom. Internal to the base 472 is a first base plate 478 and a second base plate 480. In one embodiment, the first base plate 478 and the second base plates 480 are thin metal plates, such as stainless steel with a thickness of about 0.1-0.5 millimeters.

The first base plate 478 is coupled to a rear end of the prong 474. The first base plate 478 serves as a structural base for the prong 474. In one implementation, the first base plate 478 is mechanically connected to the prong 474. The mechanical connection can, for example, be provided by (i) interlocking the prong 474 with the first base plate 458, (ii) soldering the parts together, and/or (iii) using some attachment members (such as screws, fasteners or rivets). In addition to providing mechanical connection, once the first base plate 478 is connected to the prong 474, the prong 474 and the first base plate 478 are also electrically connected. In addition, the base 472 can further include a first connection member 482 that provides a path within the base 472 from the first base plate 478 to a first connector 484 (e.g., pin or post type connector), which serves as a first terminal. The first connector 484 is electrically connected to the first base plate 478 via the first connection member 482. The first connector 484 is at least partially exposed and thus accessible on the back side of the base 472. The first connection member 482 can be integrally formed with the first base plate 478. Alternatively, the first connection member 482 can be separately formed and subsequently connected to the first base plate 478. The first connection member 482 thus permits the first connector 484 to be positioned (and oriented) in any position along the back side of the base 472.

Similarly, the second base plate 480 is coupled to a rear end of the prong 476. The second base plate 480 serves as a structural base for the prong 476. In one implementation, the second base plate 460 is mechanically connected to the prong 476. The mechanical connection can, for example, be provided by (i) interlocking the prong 476 with the second base plate 480, (ii) soldering the parts together, and/or (iii) using some attachment members (such as screws, fasteners or rivets). In addition to providing mechanical connection, once the second base plate 480 is connected to the prong 476, the prong 476 and the second base plate 480 are also electrically connected. In addition, the base 472 can further include a second connection member 486 that provides a path within the base 472 from the second base plate 480 to a second connector 488 (e.g., pin or post type connector), which serves as a second terminal. The second connector 488 is electrically connected to the second base plate 480 via the second connection member 486. The second connector 488 is at least partially exposed and thus accessible on the back side of the base 472. The second connection member 486 can be integrally formed with the second base plate 480. Alternatively, the second connection member 486 can be separately formed and subsequently connected to the second base plate 480. The second connection member 486 thus permits the second terminal 488 to be positioned (and oriented) in any position along the back side of the base 472.

The connectors 484 and 488 serve as internal connection points for the power adapter plug 470. Hence, the connectors 484 and 488 can also be referred to as internal terminals. The utilization of the base plates 478 and 480 together with the respective connection members 482 and 486 facilitates the placement of the terminals 484 and 488 anywhere along the back side of the base 472. Consequently, the interconnection of the power adapter 470 with respect to other electrical circuitry or components is greatly facilitated.

The blades (or probes) and base plates utilized in accordance with the invention can take may different sizes and configurations. The blades can also attach to the base plates in various different ways.

Figure 5A:
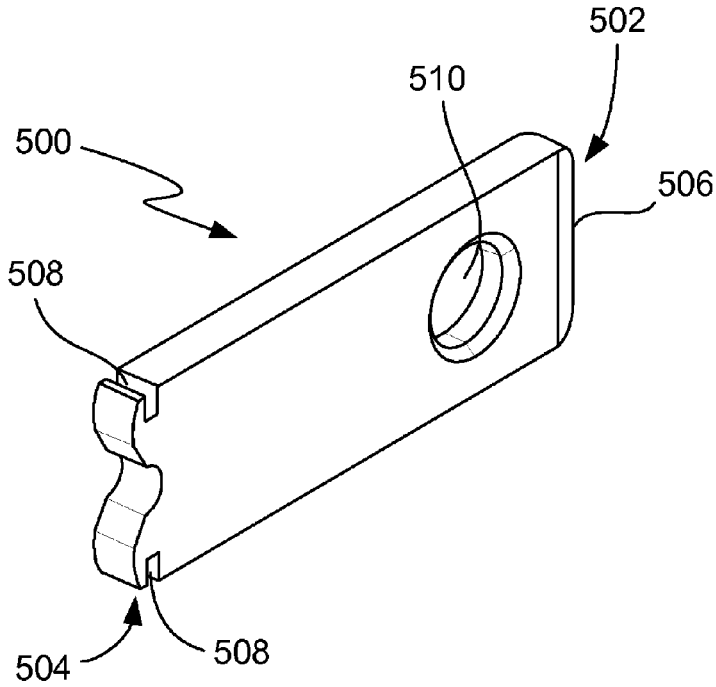
FIG. 5A illustrates an exemplary blade according to one embodiment of the invention.

FIG. 5A illustrates an exemplary blade 500 according to one embodiment of the invention. The blade 500 has a front end 502 and a back end 504. The front end 502 can be a rounded or tapered. The back end 504 can include attachment features, which in this embodiment includes notches 508. The attachment features are used to attach the blade 500 to a base plate. The blade 500 can also have an opening 510 proximate to the front end 502.

Figure 5B:
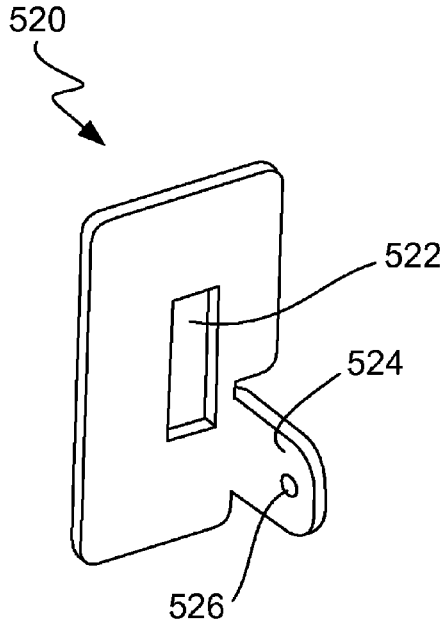
FIG. 5B illustrates an exemplary base plate according to one embodiment of the invention.

FIG. 5B illustrates an exemplary base plate 520 according to one embodiment of the invention. The base plate 520 is typically a thin metal sheet of metal, such as stainless steel. For example, the thickness of the base plate 520 can be about 0.1-0.5 millimeters. The base plate 520 has an opening 522 for receiving a blade, such as the blade 500. The base plate 520 also includes a terminal 524 which can have a small opening 526. The terminal 524 can be formed by bending a portion of the base plate 520. For example, the terminal can be formed by bending the portion of the base plate 520 normal to the surface of the base plate 520. The opening 526 facilitates electrical connection to the terminal 524.

Figure 5C:
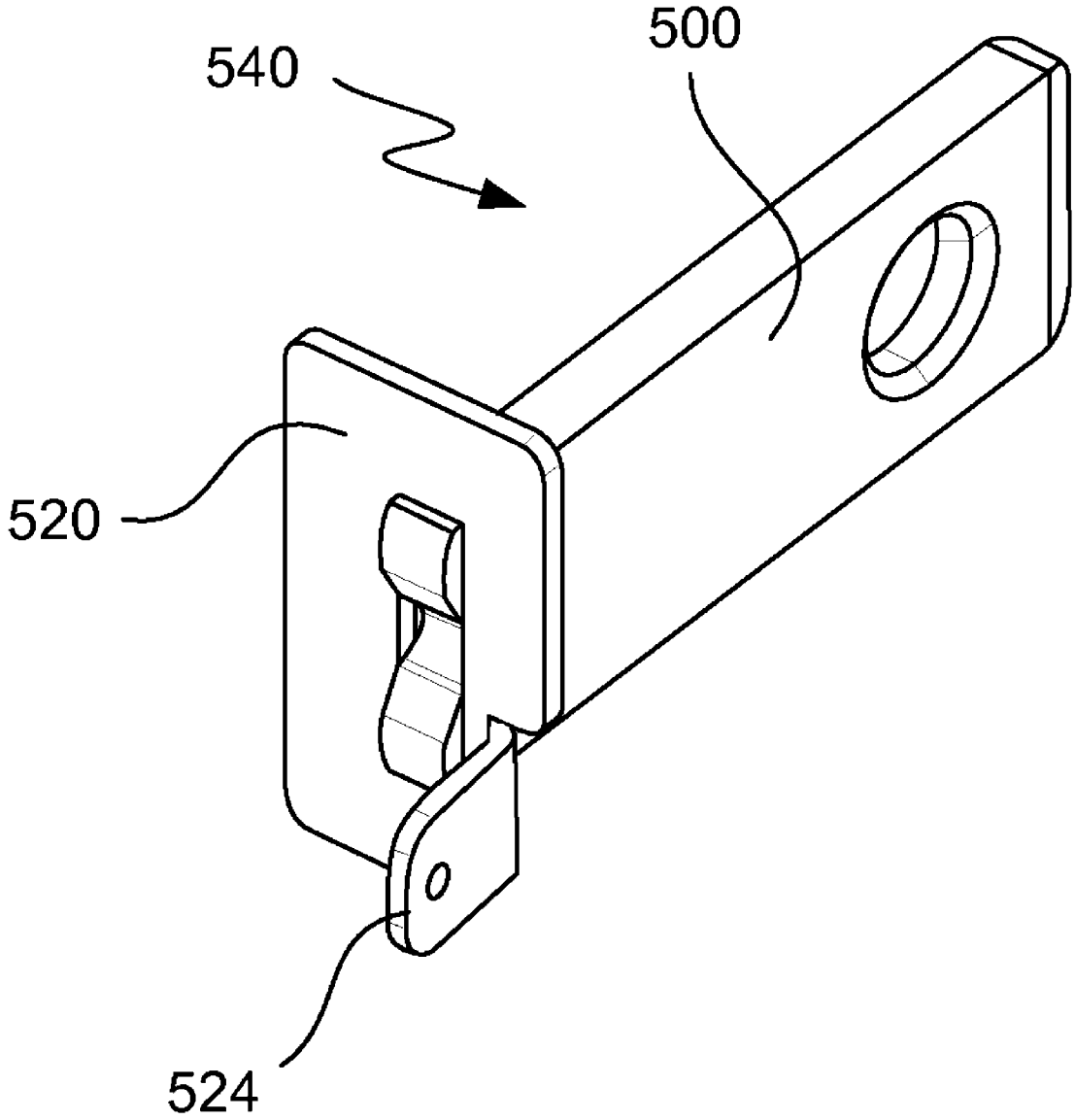
FIG. 5C illustrates an assembly of the blade illustrated in FIG. 5A and the base plate illustrated in FIG. 5B.

FIG. 5C illustrates an assembly of the blade 500 illustrated in FIG. 5A and the base plate 520 illustrated in FIG. 5B. The base plate 520 can be affixed to the blade 500 using the attachment features. Namely, the edge of the opening 522 of the base plate 520 can be received in the notches 508 of the blade 500, thereby securing the blade 500 to the base plate 520. In some cases, the attachment features can be mechanically altered (e.g., press-fit) to secure the attachment of the blade 500 to the base plate 520.

The blades (or prongs) used with the power adapter plug are metal. For example, the blades can be stainless steel or cooper. The formation of the blades can done using an extruding or stamping techniques. Stamping tends to leave shear marks which can be undesirable. Hence, it may be preferred to extrude the blades since the surface quality of the edges of the blades can clean, smooth and without shear marks. In one embodiment, the blades can be formed by extruding a metal bar having a width as desired for the height of the blades. Then, individual blades can be separated (or singulated) from the metal bar using a stamping process. Since the stamping of the metal bar does not stamp the sides of the blades (since the width is accurately set by the extruded bar), the surface quality of the sides of the blades is excellent. The exposed end (i.e., exposed tip) of the blades can usually thereafter be smoothed or rounded by a polishing or grinding step so that insertion into an AC outlet facilitated.

Figure 5D:
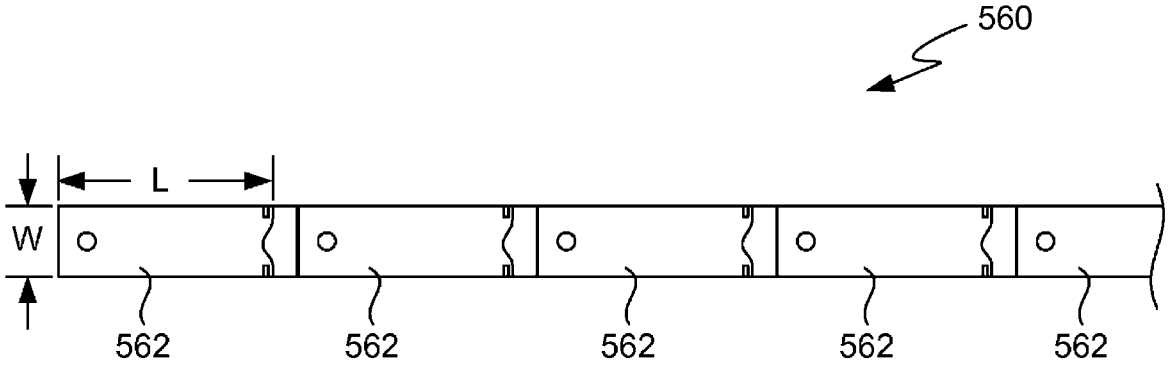
FIG. 5D illustrates an exemplary metal bar according to one embodiment of the invention.

FIG. 5D illustrates an exemplary metal bar 560 according to one embodiment of the invention. The metal bar 560 is an extruded metal bar of metal, such as sheet metal, from which a plurality of blades 562 for plugs (e.g., for power adapters) can be formed. The metal bar 560 has a width W that represents the width of the blades. Individual ones of the blades 562 having a length L can be stamped or cut from the metal bar 560. Since the metal bar 560 is extruded at the width W, the surface quality along the length L of the sides of the blades 562 is excellent. For example, there are no shear marks along the length of the blades.

Figure 6:
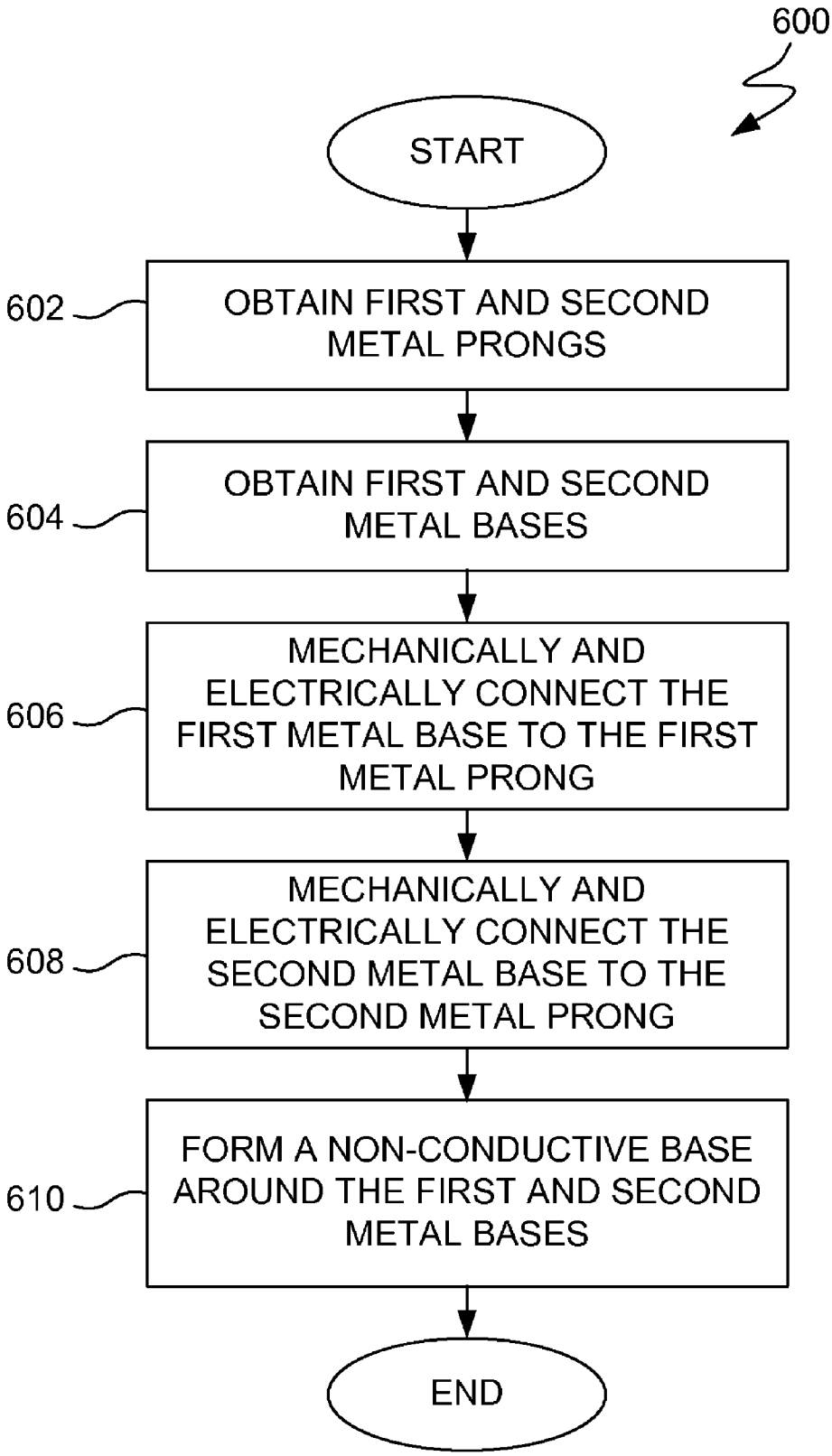
FIG. 6 is a flow diagram of a power adapter assembly process according to one embodiment of the invention.

FIG. 6 is a flow diagram of a power adapter assembly process 600 according to one embodiment of the invention. The power adapter assembly process 600 pertains to assembly or construction of a power adapter plug that is part of a power adapter. The power adapter assembly process 600 obtains 602 first and second metal prongs. In addition, first and second metal bases can be obtained 604. Next, the first metal base can be mechanically and electrically connected 606 to the first metal prong. Similarly, the second metal base can be mechanically and electrically connected 608 to the second metal prong. Thereafter, a non-conductive base can be formed 610 around the first and second metal bases. Following the block 610, the power adapter assembly process 600 can end.

In one implementation, the non-conductive base is formed 610 using an injection molding process. The utilization of the metal bases to mechanically support and electrically connect with the metal prongs allows the thickness of the non-conductive base to be relatively thin. In other words, the non-conductive base can be formed with a minimized thickness which facilitates smaller and more compact power adapter designs.

Figure 7:
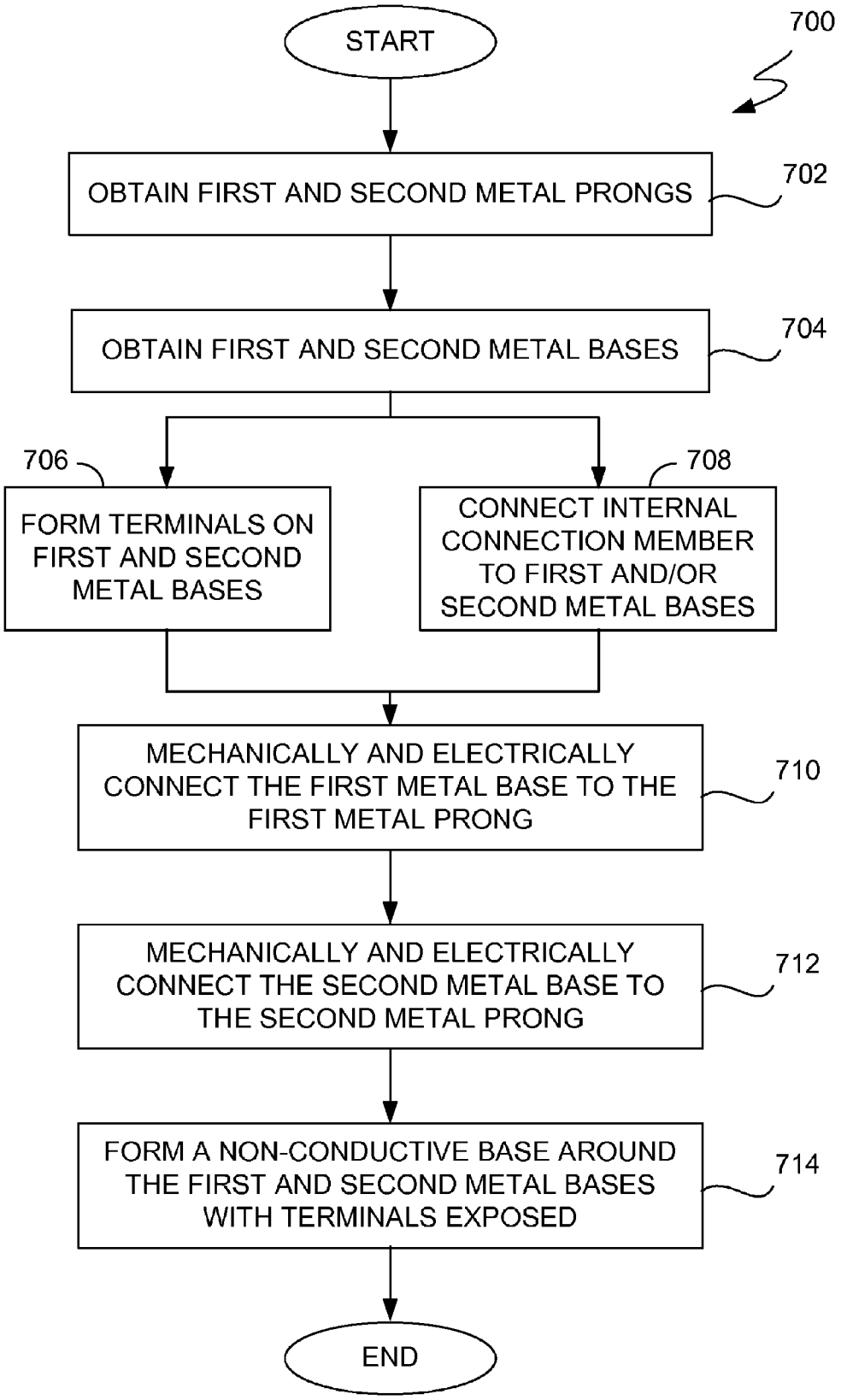
FIG. 7 is flow diagram of a power adapter assembly process according to one embodiment of the invention.

FIG. 7 is flow diagram of a power adapter assembly process 700 according to one embodiment of the invention. The power adapter assembly process 700 pertains to assembly or construction of a power adapter plug that is part of a power adapter. The power adapter assembly process 700 can obtain 702 first and second metal prongs. In addition, first and second metal bases can be obtained 704. Then, depending upon implementation, the internal terminals that are to be provided on the resulting power adapter plug can be a formed from either a portion of the metal bases or from connection members with or without use of additional parts (such as pin or post connectors). In one implementation, terminals can be formed 706 on the first and second metal bases. As an example, a portion of the first and second metal bases can be designed to be bent on assembly. Then, during assembly, the bendable portion of the metal bases can be bent into position so as to form a respective terminal. In another implementation, one or more internal connection members can be connected 708 to the first and/or second metal bases. The internal connection members can facilitate repositioning of the resulting terminals with respect to the non-conductive base of the power adapter plug. For example, one end of a connection member can be mechanically and electrically connected to the metal base and then the other end of the internal connection member can be provided with a pin or post connector that is to serve as the terminal.

In any case, following the block 706 or the block 708, the power adapter assembly process 700 can mechanically and electrically connect 710 the first metal base to the first metal prong. Similarly, the second metal base can be mechanically and electrically connected 712 to the second metal prong. Thereafter, a non-conductive base can be formed at 714 around the first and second metal bases. The non-conductive base that is formed 714 has the terminals at least partially exposed on the surface of the non-conductive base.

Additionally, after constructing the power adapter plug in accordance with the power adapter assembly process 600 illustrated in FIG. 6 or the power adapter assembly process 700 illustrated in FIG. 7, further assembly can be performed. In one embodiment, the power adapter plug can then be coupled to a printed substrate (e.g., PCB, flex-circuit) containing electrical components for adapting AC power to suitable DC power. Thereafter, if the power adapter is a stand-alone product, a housing can be placed around the assembly of the power adapter plug and the printed substrate.

The various aspects, embodiments, implementations or features of the invention can be used separately or in any combination.

The advantages of the invention are numerous. Different embodiments or implementations may, but need not, yield one or more of the following advantages. One advantage of certain embodiments of the invention is that power adapters, or power adapter plugs, can be formed with low profiles which facilitates smaller and thinner power adapters. Another advantage of certain embodiments of the invention is that in forming a power adapter plug base plates can provide structural support for blades. Still another advantage of certain embodiments of the invention is that blades for power adapters, or power adapter plugs, can be fabricated without undesired shear marks along the length of the blades.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A power adapter, comprising:

a first metal prong having a front end and a back end;

a first metal base formed of a thin stainless steel sheet having a first metal opening to mechanically and electrically connect to the back end of said first prong, said first metal base including or coupling to at least a first terminal;

a second metal prong having a front end and a back end;

a second metal base formed from a thin stainless steel sheet having a second opening to mechanically and electrically connect to the back end of said second metal prong, said second metal base including or coupling to at least a second terminal; and a molded base formed around said first and second metal bases such that said first and second metal prongs are at least partially exposed and said first and second metal bases are not exposed except for the first and second terminals which are at least partially exposed, said molded base being non-conductive, wherein said first and second metal prongs extend outward from a first side of said molded base, and the first and second terminals extend outward from a second side of said molded base, and wherein the second side is opposite the first side.

2. A power adapter as recited in claim 1, wherein said molded base is plastic.

3. A power adapter as recited in claim 1, wherein said molded base has a thickness of less than or equal to about three (3) millimeters.

4. A power adapter as recited in claim 1, wherein the first and second terminals are positionable anywhere on the second side of said molded base.

5. A power adapter as recited in claim 1, wherein at least the first terminal comprises a connector mechanically and electrically connected to said first metal base.

6. A power adapter as recited in claim 1, wherein the first terminal is integrally formed with said first metal base.

7. A power adapter as recited in claim 1, wherein the first terminal is formed from a bent portion of said first metal base.

8. A power adapter as recited in claim 1, wherein at least one of the first and second terminals comprises a connector.

9. A power adapter as recited in claim 1, wherein said first metal base includes or couples to a first connection member, and wherein one end of the first connection member is integral with or connected to said first metal base, and another end of the first connection member is connected to the first terminal.

10. A power adapter as recited in claim 9, wherein the first terminal comprises a connector.

11. A power adapter as recited in claim 1, wherein the thickness of said molded base is less than the thickness of either of said first and second prongs.

12. A power adapter as recited in claim 1, wherein the thickness of said molded base is about 2.5 millimeters.

13. A method for assembling a power adapter, said method comprising:

obtaining a first metal prong for the power adapter, the first metal prong having a front end and a back end, with the back end having at least one attachment feature;

forming a first metal base from a thin stainless steel sheet having at least a first terminal and one opening to receive the at least one attachment feature of the first metal prong, wherein the first terminal is formed from a bent portion of the first metal base;

securing the first metal prong proximate to the at least one opening of the first metal base using the at least one attachment feature, thereby providing a mechanical and electrical connection between the first metal prong and the first metal base; and forming a non-conductive base around the first metal base to encapsulate the first metal base while the first metal prong and the first terminal remain at least substantially exposed, wherein the first metal prong extends outward from a first side of the non-conductive base, and the first terminal extends outward from a second side of the non-conductive base, and wherein the second side is opposite the first side.

14. A method as recited in claim 13, wherein said forming comprises injection molding to form the non-conductive base.

15. A method as recited in claim 13, wherein the first terminal is formed by bending a first terminal portion of the first metal base.

16. A method as recited in claim 13, wherein the first terminal is offset from the position of the first metal prong.

17. A method as recited in claim 13, wherein the first terminal comprises a first connector.

18. A method as recited in claim 17, wherein said method further comprises:

attaching a first end of a first connection member to the first metal base;

attaching the first connector to a second end of the first connection member; and positioning the first connector with respect to the first metal base.

19. A method as recited in claim 13, wherein the power adapter includes a first terminal, and wherein a first connection member offsets the first terminal from the first metal base.

20. A method as recited in claim 13, wherein said method, prior to said forming, further comprises:

obtaining a second metal prong for the power adapter, the second metal prong having a front end and a back end, with the back end having at least one attachment feature;

obtaining a second metal base having at least one opening to receive the at least one attachment feature of the second metal prong; and securing the second metal prong to the at least one opening of the second metal base using the at least one attachment feature, thereby providing a mechanical and electrical connection between the second metal prong and the second metal base.

21. A method as recited in claim 20, wherein said forming operates to form the non-conductive base around the first metal base as well as the second metal base so as to encapsulate the first metal base and the second metal base while the first metal prong and the second metal prong remain at least partially exposed.

22. A method for assembling a power adapter, said method comprising:

obtaining a first metal prong for the power adapter, the first metal prong having a front end and a back end, with the back end having at least one attachment feature;

obtaining a first metal base having at least a first terminal and one opening to receive the at least one attachment feature of the first metal prong;

securing the first metal prong proximate to the at least one opening of the first metal base using the at least one attachment feature, thereby providing a mechanical and electrical connection between the first metal prong and the first metal base; and forming a non-conductive base around the first metal base to encapsulate the first metal base while the first metal prong and the first terminal remain at least substantially exposed, wherein said obtaining of the first metal prong comprises:

receiving an extruded metal bar having a width of the first metal prong; and separating the first metal prong having a length from the extruded metal bar.

23. A power adapter plug, comprising:

a first metal prong having a front end and a back end;

a first metal base formed from a stainless steel sheet having a first opening to mechanically and electrically connected to the back end of said first metal prong, said first metal base including or coupling to at least a first terminal formed from a bent portion of said first metal base;

a second metal prong having a front end and a back end;

a second metal base formed from a stainless steel sheet having a second opening to mechanically and electrically connected to the back end of said second metal prong, said second metal base including or coupling to at least a second terminal formed from a bent portion of said second metal base; and a non-conductive base formed around said first and second metal bases such that said first and second metal prongs and the first and second terminals are at least partially exposed, wherein said first and second metal prongs extend outward from a first side of said non-conductive base, and the first and second terminals extend outward from a second side of said non-conductive base, and wherein the second side is opposite the first side.

24. A power adapter plug as recited in claim 23, wherein said non-conductive base has a thickness of less than or equal to about three (3) millimeters, and wherein said first metal base or said second metal base has a thickness of less than or equal to about 0.1-0.5 millimeters.

25. A power adapter plug as recited in claim 24, wherein said non-conductive base is plastic and formed by injection molding.

26. A power adapter plug as recited in claim 23, wherein said first metal prong is formed from a first extruded metal bar having a width of said first metal prong, and wherein said second metal prong is formed from the first extruded metal bar or a second extruded metal bar having a width of said second metal prong.

* * * * *

UNITED STATES PATENT AND TRADEMARK OFFICE

CERTIFICATE OF CORRECTION

PATENT NO. : 8,021,198 B2
APPLICATION NO. : 12/135044
DATED : September 20, 2011
INVENTOR(S) : Lim et al.

It is certified that error appears in the above-identified patent and that said Letters Patent is hereby corrected as shown below:

Col. 12, lines 51-52 (Claim 23), "connected" should be --connect--

Col. 12, line 58 (Claim 23), "connected" should be --connect--

Signed and Sealed this
First Day of May, 2012

David J. Kappos

David J. Kappos
*Director of the United States Patent and Trademark Office*